US006685776B1

(12) United States Patent
Paver et al.

(10) Patent No.: US 6,685,776 B1
(45) Date of Patent: Feb. 3, 2004

(54) BEARING COMPONENT MASKING UNIT

(75) Inventors: Ed Paver, Yorkville, IL (US); Adam M. Theros, Plainfield, IL (US); Tim Ross, Yorkville, IL (US)

(73) Assignee: Emerson Power Transmission Manufacturing, L.P., Maysville, KY (US)

( * ) Notice: Subject to any disclaimer, the term of this patent is extended or adjusted under 35 U.S.C. 154(b) by 0 days.

(21) Appl. No.: 10/298,758

(22) Filed: Nov. 18, 2002

(51) Int. Cl.[7] ..... B05C 11/11

(52) U.S. Cl. ..... 118/505; 118/500; 118/504; 427/282; 427/256; 269/16; 269/287

(58) Field of Search ..... 118/500, 504, 118/505, 56, 406, 301, 317, 428; 427/272, 282, 284, 287, 421–427, 230–239, 435–438

(56) References Cited

U.S. PATENT DOCUMENTS 2,905,512 A * 9/1959 Anderson ..... 277/442
3,850,669 A * 11/1974 Mino et al. ..... 427/422
5,686,144 A * 11/1997 Thebault et al. ..... 427/282
6,312,522 B1 * 11/2001 Dinh et al. ..... 118/407

* cited by examiner

*Primary Examiner*—Richard Crispino
*Assistant Examiner*—Michelle A Lazor
(74) *Attorney, Agent, or Firm*—McDonnell Boehnen Hulbert & Berghoff

(57) ABSTRACT

A housing having an inner surface and having a bottom end, a bearing component positioned within the housing above the bottom end of the housing, a first seal positioned within the housing between the bottom end of the housing and the bearing component, the first seal sized to provide a seal against the inner surface of the housing and to cover the a first sidewall surface of the bearing component, a top end of the housing positioned opposite the bottom end, a second seal positioned within the housing between the bearing component and the top end of the housing, the second seal sized to provide a seal against the inner surface of the housing and to cover a second sidewall surface of the bearing component during a coating operation.

28 Claims, 3 Drawing Sheets

BEARING COMPONENT MASKING UNIT

BACKGROUND OF INVENTION

1. Field of Invention

The present invention is directed generally to bearing components, and more particularly bearing component masking unit and method of using same used to prevent selected surfaces of a bearing component from being coated during a coating process.

2. Background of the Invention

Bearing assemblies have been used in connection with rotating shafts and components for years. Often, bearing assemblies are subjected to harsh operating conditions and working environments. As a result, it is often desirable to apply a coating to certain bearing components in view of the particular operating conditions or working environment in which the bearing will be used. For example, for heavy load or high speed applications, a coating adapted to increase wear resistance may be added to a particular bearing component. Alternatively, for highly corrosive working environments, it may be desirable to apply a corrosion resistant protective coating to a particular bearing component. Regardless of the type of coating selected, it is often desirable to apply the coating to certain surfaces of the bearing component, and leave other surfaces uncoated.

In the past, masking tape or vinyl tape was placed over the surfaces which were desired to be left uncoated. For example, in the case of certain sleeve bearings, a coating is desired in the bore, or inner surface, of the sleeve, but not on the sidewall surfaces or the outer surface. Using masking or vinyl tape works moderately well for covering the outer surface of the sleeve. However, when using masking or vinyl tape on the sidewall surfaces, often some of the coating intended only for the bore would wind up on the sidewall surface, necessitating some post-coating processing to remove the extraneous coating from the sidewall surface. In addition, the masking or vinyl tape often leaves an adhesive residue on the sidewall surface and the outer surface requiring a post-coating cleaning of the sleeve sidewall surfaces and the outer surface. Consequently, the prior art coating and masking methods required undesirable post-coating processing that is costly and time-consuming. Thus, there is a need in the art for a way to provide a coating on certain surfaces of a bearing component without coating unintended surfaces and reducing costly and time-consuming post-processing measures.

SUMMARY OF THE INVENTION

The present invention is specifically directed to a bearing component masking unit adapted for coating surfaces of a bearing component while leaving other surfaces uncoated. In a disclosed embodiment, a bearing component masking unit is shown that is adapted to house one or more bearing components to be coated. The disclosed embodiment includes a housing having a preferably, but not necessarily, cylindrical inner surface and having a bottom end, where the housing is adapted so that a bearing component may be positioned within the housing above the bottom end of the housing. A first seal may be positioned within the housing between the bottom end of the housing and the bearing component, where the first seal may be sized to provide a seal against the inner surface of the housing and may also cover the first sidewall surface of the bearing component. A top end of the housing is positioned opposite the bottom end, and a second seal may be positioned within the housing between the bearing component and the top end of the housing, where the second seal may be sized to provide a seal against the inner surface of the housing and also to cover a second sidewall surface of the bearing component during a coating operation.

Thus, the present invention provides a way to provide a coating on certain surfaces of a bearing component without coating unintended surfaces and may reduce the costly and time-consuming post-processing measures required by prior masking techniques.

BRIEF DESCRIPTION OF THE DRAWINGS

Further advantages of the present invention will become apparent to those skilled in the art with the benefit of the following detailed description of the preferred embodiments and upon reference to the accompanying drawings in which.

Figure 1:
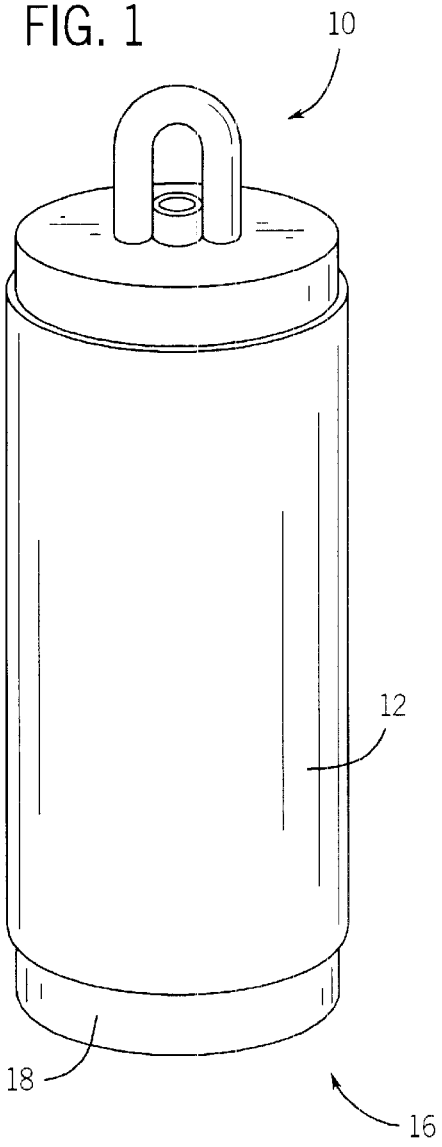
FIG. 1 is a perspective view of a bearing component masking unit.

While the invention is susceptible to various modifications and alternative forms, specific embodiments thereof are shown by way of example in the drawings and will herein be described in detail. It should be specifically understood with respect to the drawings, that the drawings are of a preferred embodiment, and there are many other embodiments and forms in which the present invention may appear. It should also be understood that the drawings and detailed description thereof are not intended to limit the invention to the particular form disclosed, but on the contrary, the invention is to cover all modifications, equivalents and alternatives falling within the spirit and scope of the present invention or within the scope of the appended claims.

DETAILED DESCRIPTION OF PREFERRED EMBODIMENTS

Figure 2:
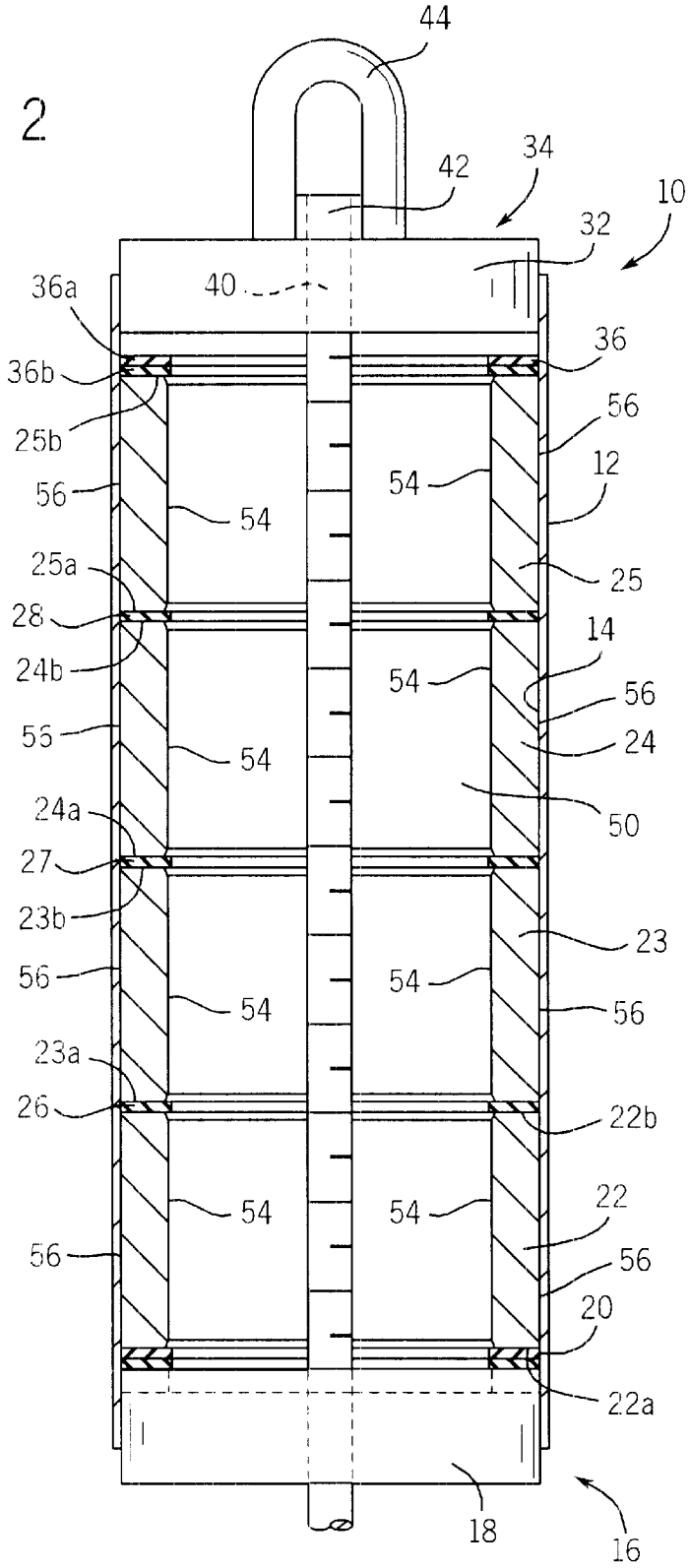
FIG. 2 is a cross-sectional view of the bearing component masking unit of FIG. 1.

With reference to FIGS. 1 and 2, a bearing component masking unit 10 is shown. The masking unit 10 is comprised of a housing 12 having a preferably cylindrical inner surface 14. Housing 12 further includes a bottom end 16 which may include a first fixture 18 attached thereto. Positioned within housing 12 is a bottom end seal 20 which may be comprised of one or more gaskets. The bottom end seal 20 is in sealing contact with the inner surface 14 of the housing 12. A bearing component 22 is positioned within the housing 12 above the bottom end seal 20. The lower sidewall surfaces 22*a* of the bearing component 22 contacts bottom end seal 20.

An additional seal 26 is positioned within the housing and above the bearing component 22. Seal 26 is in sealing contact with the inner surface 14 of the housing 12 and covers the upper sidewall surface 22*b* of the bearing component 22. As shown in FIG. 2, additional bearing component 23 is positioned above seal 26. The lower sidewall 23*a* is covered by the seal 26. An additional seal 27 is positioned within the housing and above the bearing component 23. Seal 27 is in sealing contact with the inner surface 14 of the housing 12 and covers the upper sidewall surface 23*b* of the bearing component 23. Additional bearing components 24 and 25 are shown within the housing 12. Seal 28 is positioned between bearing components 24 and 25 and covers the upper sidewall 24*b* of bearing component 24 as well as lower sidewall 25*a* of bearing component 25.

A top fixture 32 is attached to the housing 14 at the top end 34 of the masking unit 10. A top end seal 36 is positioned within the housing at the top end 34 and is in sealing contact with the inner surface 14 of the housing 12. Top end seal 36 may be comprised of one or more gaskets. In FIG. 2 the top end seal 36 is shown as a pair of gaskets 36*a*, 36*b*. A rod 40 is shown extending from top fixture 32 to the bottom end 16 of the housing and into engagement with the bottom fixture 18. In this embodiment, bottom fixture 18 is fixedly attached to the housing 12, whereas top fixture 32 is sized and positioned so as to be moveable within the housing 12. A threaded nut 42 is positioned above and against the top fixture rod 40 and threadingly engaged to the rod 40. Once the bearing components and seals have been placed within the housing, the top fixture 32 is positioned within the housing and into contact with the top end seal 36. As the nut 42 is tightened, the top fixture 32 within the housing is drawn towards the bottom fixture 18 of the housing. As a result, the seals positioned between each of the bearing components, and the top end seal and the bottom end seal are compressed, and effect a seal against the inner surface 14 of the housing 12.

As shown in FIG. 2, the masking unit 10 also includes a lift 44 attached to the nut 42. The lift allows the masking unit 10 to be lifted and transported, as well as lowered into a coating bath. For example, once the bearing components to be coated have been positioned within the housing, and the nut is tightened to compress the seals, the masking unit may be lowered into a vat or bath of the coating material. An unlimited number of coating materials can be used depending on the purpose and application of the component. For example, a common coating on bearing components is thin dense chrome (TDC). In addition, sleeve bearings often use break-in type coatings, such as various phosphate coatings. The masking unit 10 is lowered into and submerged in the coating bath where holes in the top fixture 32 and bottom fixture 18 allow the bath to permeate and fill the interior portion 50 of the housing. The top end seal 36 and bottom end seal 20 prevent the bath from contacting inner surface 14 of the housing or the outer surfaces of the bearing components. Further the seals 26–28 positioned between the bearing components cover the sidewall surfaces of the bearing components and prevent contact thereof with the coating, as well as prevent the coating from seeping through toward the inner surface of the housing. Consequently, upon removal of the masking unit from the bath, only the inner surfaces 54 of the bearing components are coated. In this manner, a coating is applied to only selected surfaces of the bearing components. In the disclosed embodiment of FIG. 2, the coating is applied to the inner surface of a sleeve bearing component.

Alternately, the masking unit 10 could be configured such that there was no seal against the inner surface 14 of the housing, such that coating would be allowed to cover the inner surfaces 54 and the outer surfaces 56 of the bearing components. As shown in FIG. 2, the seals 16–28 would cover only the sidewall surfaces and allow a coating to be provided on inner surfaces 54 and outer surfaces 56 of the bearing components.

In another alternate embodiment, the masking unit could be configured such that the seals 26–28 are provided between the sidewall surfaces of the bearing components, and a seal provided to prevent the coating from contacting the inner surfaces 54 of the bearing components, but no seal provided against the inner surface 14 of the housing. In this manner, the coating would be allowed to cover only the outer surfaces 56 of the bearing components.

It will be understood that there are many different ways in which the coating may be applied to the selected surfaces of the bearing components. As an example, rather than submerging the masking unit in a bath, the coating may be applied to the inner exposed bearing component surfaces 54 by spraying, brushing, vapor depositing, electrostatic powder coating, baking processes, or any other manner suitable to apply a coating to a bearing component.

The housing 12 may be constructed of any material suitable to house bearing components, including plastic. Preferably, however it is a durable metal material, most preferably a stainless steel such as a 316 stainless steel which has good corrosion resistant properties. The top fixture 32 and the bottom fixture 18 may also be constructed of any material suitable for use in the bearing masking unit, including plastic. Preferably, however, it is a durable material, most preferably a stainless steel such as a 316 stainless steel.

The nut 42 and threaded rod 40 are also preferably made of a stainless steel. The threaded rod 40 is shown extending through the inside of housing 12 and is mounted in the bottom fixture 18. The threaded rod 40 is preferably has a diameter of one inch. As noted above, as the nut 42 is tightened the top fixture 32 is drawn toward the bottom fixture 16 to compress the seals. However, many other mechanical methods may be employed to push the top fixture 32 towards the bottom fixture 18. Other methods include simply providing a threaded top fixture that is threadingly engaged with the inner surface of the housing, or providing a plunger assembly, side clamps like those used on a fruit jar, or a spring biased assembly to exert a downward force on the top fixture. In fact, any mechanical device suitable to exert such a downward force on the top fixture to compress the seals may be used. The lift 44 may be made of any material suitable to support the weight of the bearing component masking unit. Preferably, lift 44 is made of metal and welded to the top fixture or welded to the nut 42 such that the nut 42 may be tightened by turning the lift 44. The lift preferably includes a one-half inch stainless steel rod that is attached with a stainless steel weld.

Figure 4:
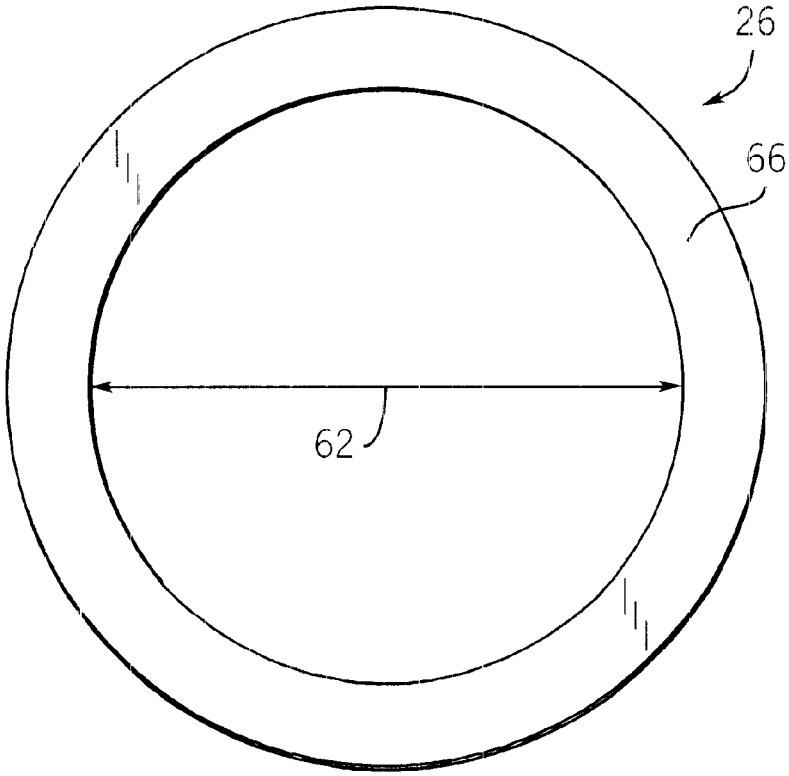
FIG. 4 is a top view of a seal shown in the bearing component masking unit of FIG. 2.
Figure 5:
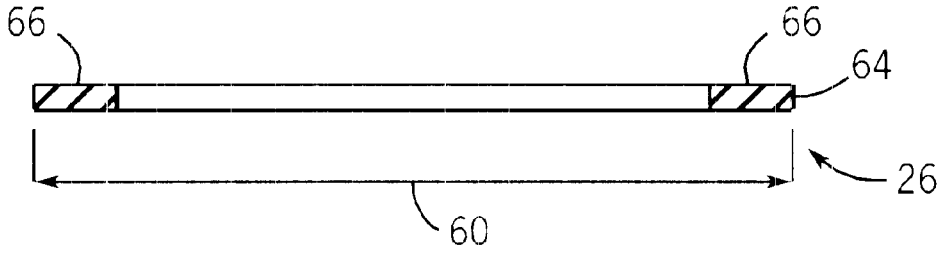
FIG. 5 is a cross-sectional view the seal of FIG. 4.

FIGS. 4 and 5 show a top view and a cross-sectional side view of the seals 26–28 of FIG. 2. The seals are preferably annular seals having a thickness of 0.250 inches and made of a high-grade buna rubber having a durometer hardness of Shore A 50. The diameter of the inner surface 14 of the housing is slightly larger than the diameter of the outer surface of the bearing component 22. This sizing facilitates the positioning of the bearing component in the housing prior to coating, as well as its removal after the coating has been applied. In addition, the outer diameter 60 of the seal 26 is preferably slightly larger than the diameter of the inner surface 14 of the housing, and thus also larger than the diameter of the outer surface of the bearing component. The inner diameter 62 of the seal is preferably slightly less than the inner diameter of the inner bearing surface 54. Thus, because the inner diameter 62 of the seal is less than the inner diameter of the inner surface 54 of the bearing component, and the outer diameter 60 of the seal is larger that the outer diameter of the outer surface of the bearing component, the entire sidewall surfaces of the bearing components are covered by the faces 66 of the seal. The coverage of the sidewall surfaces of the bearing components by the seal faces 66 of the seal prevent the sidewall surfaces from being coated during the coating process. Moreover, because the outer diameter 60 of the seal is larger than the diameter of the inner surface 14 of the housing 12, an additional seal is formed preventing the coating from extending to the outer surfaces of the bearing components.

As an example, where the diameter of the outer surface of bearing component 22 is 9.052 inches, the diameter of the inner surface 14 of the housing 12 is slightly larger measuring 9.065 inches. In this example outer diameter 60 of seal 26 is 9.125 inches. Similarly, where the diameter of the inner surface 54 of bearing component 22 is 7.091 inches prior to coating, the inner diameter 62 of the seal 26 is 7.100 inches. It will be appreciated that similar ratios of the various diameters will be suitable for bearing components having smaller or larger diameters.

Figure 3:
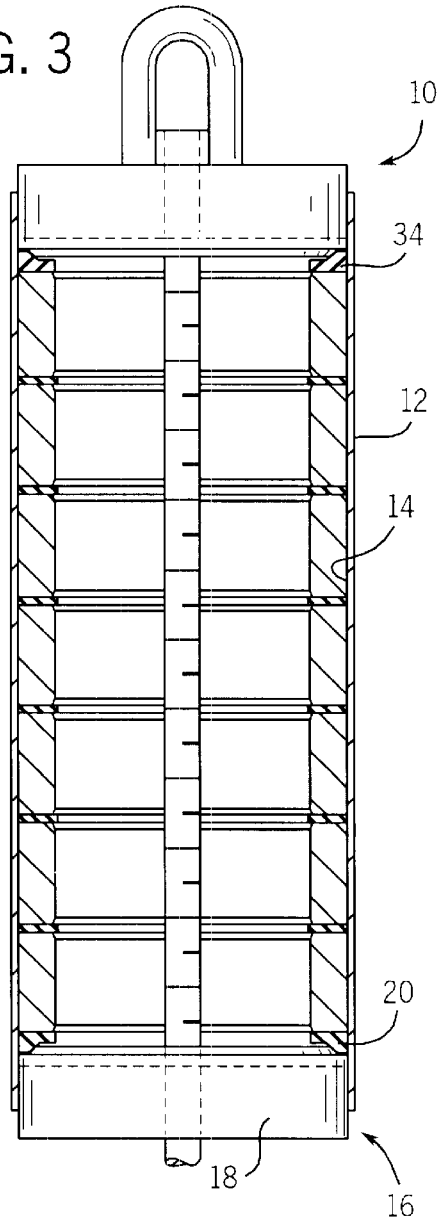
FIG. 3 is a cross-sectional view of an alternate embodiment of the bearing component masking unit of FIG. 1.

In FIG. 2, the top end seal 34 and the bottom end seal 20 are shown as a pair of stacked gaskets of the type shown in FIGS. 4 and 5. However, these seals could be made of any configuration and size. Preferably they are sized sufficiently to provide a seal against the inner surface 14 of the housing. As an example, FIG. 3 shows a bearing component masking unit having an alternate embodiment of top end seal 34 and bottom end seal 20. Moreover, any material suitable to form a seal against the inner surface 14 of the housing 12 could be used. For example, an elastomeric material, a material such as felt, a plastic material, or even a metal could be used.

It will be understood that the present invention may be used with one or more bearing components. For example, FIG. 2 depicts four bearing components, whereas the embodiment of FIG. 3 depicts seven bearing components. Thus, any number of bearing components may be positioned within the bearing component masking unit of the present invention.

What is claimed is:

1. A bearing component masking unit comprising:

a housing having an inner surface;

a first fixture attached to a first end of the housing;

a seal positioned within the first end of the housing and sized to provide a seal against the inner surface of the housing;

a plurality of seals adapted to provide a seal against the inner surface of the housing and adapted to cover sidewall surfaces of respective additional bearing components when positioned within the housing;

a second fixture positioned within a second end of the housing;

a seal positioned within the second end of the housing and sized to provide a seal against the inner surface of the housing; and a means for drawing the first fixture toward the second fixture.

2. The bearing component masking unit of claim 1, first fixture is moveably positioned within the housing.

3. The bearing component masking unit of claim 1, wherein the means for drawing the first fixture toward the second fixture includes a threaded rod and a nut.

4. The bearing component masking unit of claim 1, wherein the plurality of seals are adapted to cover the sidewall surfaces of bearing components during a coating process.

5. The bearing component masking unit of claim 4, wherein the bearing components are sleeve bearing components.

6. The bearing component masking unit of claim 4, wherein the plurality of seals are adapted to seal the outer surfaces of the bearing components during a coating process.

7. The bearing component masking unit of claim 6, wherein the bearing components are sleeve bearing components.

8. The bearing component masking unit of claim 1, further including a lift.

9. The bearing component masking unit of claim 1, wherein the plurality of seals are comprised of nitrile.

10. The bearing component masking unit of claim 1, wherein the plurality of seals are annular.

11. The bearing component masking unit of claim 10, wherein the respective bearing components are sleeve bearings.

12. The bearing component masking unit of claim 1, wherein the plurality of seals have an inner diameter that is less than an inner diameter of the respective bearing components.

13. A bearing component masking unit comprising:

a housing having an inner surface and having a bottom end;

a bearing component positioned within the housing above the bottom end of the housing;

a first seal positioned within the housing between the bottom end of the housing and the bearing component, the first seal sized to provide a seal against the inner surface of the housing and to cover a first sidewall surface of the bearing component;

a top end of the housing positioned opposite the bottom end;

a second seal positioned within the housing between the bearing component and the top end of the housing, the second seal sized to provide a seal against the inner surface of the housing and to cover a second sidewall surface of the bearing component.

14. The bearing component masking unit of claim 13, wherein the bearing component is a sleeve bearing.

15. The bearing component masking unit of claim 13, further including an additional bearing component positioned within the housing above the bearing component; and a third seal positioned between the additional bearing component at the top end of the housing, the third seal sized to provide a seal against the inner surface of the housing and to cover a sidewall surface of the additional bearing component.

16. The bearing component masking unit of claim 15, further including a force generator to draw the bottom end of the housing and the top end of the housing toward each other to help the sealing effect of the seals.

17. The bearing component masking unit of claim 15, wherein the plurality of additional seals cover the sidewall surfaces of the bearing components during a coating process.

18. The bearing component masking unit of claim 17, wherein the bearing components are sleeve bearing components.

19. The bearing component masking unit of claim 17, wherein the plurality of seals are adapted to seal the outer surfaces of the bearing components during a coating process.

20. The bearing component masking unit of claim 17, wherein the bearing components are sleeve bearing components.

21. The bearing component masking unit of claim 13, further including one or more additional bearing components positioned within the housing; and one or more additional seals positioned between adjacent sidewalls of the additional bearing components, the one or more additional seals sized to provide a seal against the inner surface of the housing.

22. The bearing component masking unit of claim 21, wherein the one or more additional bearing components are sleeve bearings.

23. The bearing component masking unit of claim 21, further including a means for pushing the first end of the housing towards the second end.

24. The bearing component masking unit of claim 21, wherein the plurality of seals are annular.

25. The bearing component masking unit of claim 24, wherein the respective bearing components are sleeve bearings.

26. The bearing component masking unit of claim 21, wherein the plurality of seals have an inner diameter that is less than an inner diameter of the respective bearing components.

27. The bearing component masking unit of claim 13, further including a means for pushing the first end of the housing towards the second end.

28. The bearing component masking unit of claim 13, wherein the seals are comprised of nitrile.

* * * * *